United States Patent [19]

Steeves

[11] 4,040,864

[45] Aug. 9, 1977

[54] DEVICE AND METHOD FOR CLEANING LEAVES AND DEBRIS FROM SWIMMING POOLS

[76] Inventor: Claire L. Steeves, 1300 Mistletoe, Fort Worth, Tex. 76110

[21] Appl. No.: 666,507

[22] Filed: Mar. 12, 1976

[51] Int. Cl.[2] ..... B08B 7/00

[52] U.S. Cl. ..... 134/6; 15/1.7; 134/24; 134/34; 134/167 R; 210/169; 210/242 R

[58] Field of Search ..... 134/6, 18, 24, 34, 167 R, 134/168 R; 15/1.7; 210/169, 242 R

[56] References Cited

U.S. PATENT DOCUMENTS

| | | | |
|---|---|---|---|
| 3,220,037 | 11/1965 | Ruhling | 15/1.7 |
| 3,928,202 | 12/1975 | Raubenheimer | 210/169 |
| 3,932,281 | 1/1976 | Pansini | 210/169 |

FOREIGN PATENT DOCUMENTS

| | | | |
|---|---|---|---|
| 590,252 | 1/1960 | Canada | 210/169 |

*Primary Examiner*—Robert L. Lindsay, Jr.

*Assistant Examiner*—George C. Yeung

*Attorney, Agent, or Firm*—Wofford, Felsman, Fails & Zobal

[57] ABSTRACT

A device for cleaning leaves and debris from swimming pools comprising a reticulated bag having an open mouth and closed end. The mouth is connected to the nozzle of a high pressure water hose, which in turn is connected to an automatic swimming pool cleaner of the type that floats and propels itself about the pool by means of a high pressure water supply. A flotation collar is connected to the bag so that it will float semi-submerged, a portion of the mouth being above the water to trap floating leaves and debris. The flotation collar is detachable so that the hose and bag will sink for cleaning the bottom of the pool. The hose is sufficiently flexible and weighted so that the bag can tip upward while on bottom, with the mouth facing the bottom and the hose on the forward side of the mouth. The rearward side of the mouth scrapes the bottom, aiding in trapping leaves from the bottom as the swimming pool cleaner drags the hose and bag about the pool.

10 Claims, 5 Drawing Figures

Fig. 4
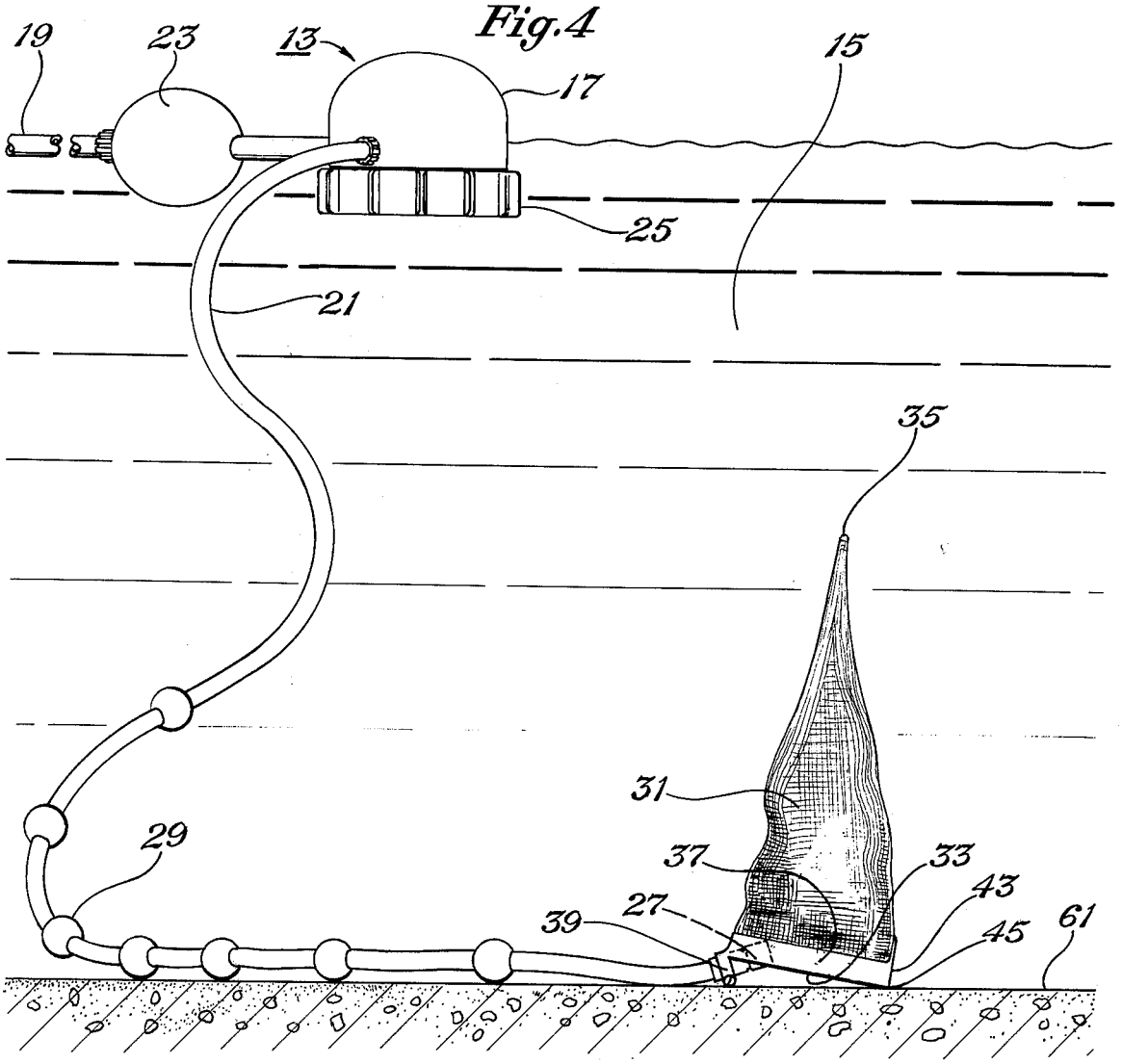
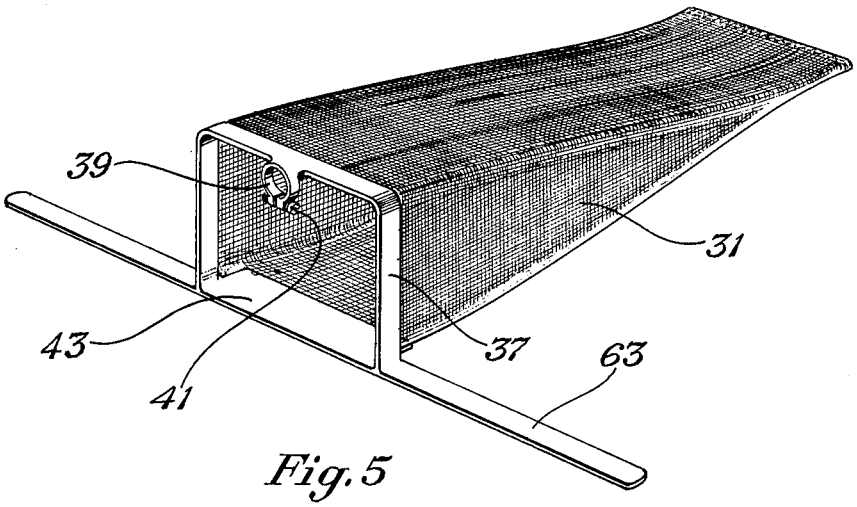
Fig. 5

DEVICE AND METHOD FOR CLEANING LEAVES AND DEBRIS FROM SWIMMING POOLS

BACKGROUND OF THE INVENTION

1. Field of the Invention

This invention relates in general to swimming pool cleaners and in particular to a device for cleaning leaves and debris from the swimming pool.

2. Description of the Prior Art

Removal of leaves and debris from swimming pools is a continuing problem. After the leaves have floated on the surface for a period of time, they sink to the bottom of the pool. It is a time-consuming and difficult task to remove the leaves, which become slimy and partially decomposed. Many devices are known for recovering the leaves while floating and from the bottom. Most of the devices are attached to a long pole and manually operated, such as the device disclosed in U.S. Pat. No. 3,063,077 issued to Pansini. Constant attendance however is required to entrap the leaves prior to their sinking. Cleaning the leaves from the bottom, even with the aid of such a device, can be a time-consuming operation.

A floating, self-operating surface skimmer and filter is disclosed in U.S. Pat. No. 3,372,809 issued to Spitzer. That patent discloses a device that has a reticulated bag lying semi-submerged at the end of a discharge tube from the filter pump. Circulation of water forces leaves into the mesh bag. The bag and tube are stationary, however, and the entire filter assembly must be manually moved about various points along the side of the pool. Also the bag is adapted for cleaning only leaves found on the water surface, not on the bottom.

Automatic floating devices which self-propel themselves about a pool are known, such as the one disclosed in U.S. Pat. No. 3,170,180 issued to Mitchell. Generally these devices can be described as a floating body having a high pressure hose attached to it. Part of the high pressure water is used in jets to propel the floating body around the pool. A discharge hose having a nozzle is connected to the floating body. The pressurized water discharging out of the nozzle causes the hose to writhe, repositioning itself adjacent the pool walls and floor. The high pressure spray dislodges sediment on the wall and floor, which is filtered by the pool circulation system. These devices however do not recover leaves, floating or submerged.

SUMMARY OF THE INVENTION

It is a general object to provide an improved device for cleaning leaves and debris from the swimming pool.

It is a further object to provide an improved device that will clean leaves and debris from the surface and from the bottom without manual operation.

It is a further object of this invention to provide an improved device for cleaning leaves and debris from a swimming pool that is drawn about the pool by a floating self-propelled swimming pool cleaner.

It is a further object to provide an improved method of cleaning leaves and debris from the bottom of the pool.

In accordance with these objects, an improved leaf and debris collecting device is provided that is adapted for connection to an automatic self-propelled pool cleaner of the type having a floating body powered by high pressure water supply and having a flexible outlet discharge hose. The leaf collecting device includes a reticulated bag, the mouth of which is connected to the nozzle of the outlet hose. A flotation collar is adapted to slide over the mouth to suspend the bag in semi-submerged condition to trap leaves as the automatic cleaner drags the hose and bag about the pool. The flotation collar is removable so that the bag and nozzle will sink for collecting leaves from the bottom. For the bottom scavaging operation, the bag is inverted with the mouth facing downwardly and the nozzle connected to the forward side. The rearward side serves as a scraper against the bottom of the pool to prevent any leaves and debris from escaping.

BRIEF DESCRIPTION OF THE DRAWINGS

FIG. 4 is a side elevational view of the leaf collecting device in accordance with this invention shown on the bottom of the swimming pool.

FIG. 5 is an alternate embodiment of the leaf collecting device in accordance with this invention.

DESCRIPTION OF THE PREFERRED EMBODIMENT

Figure 1:
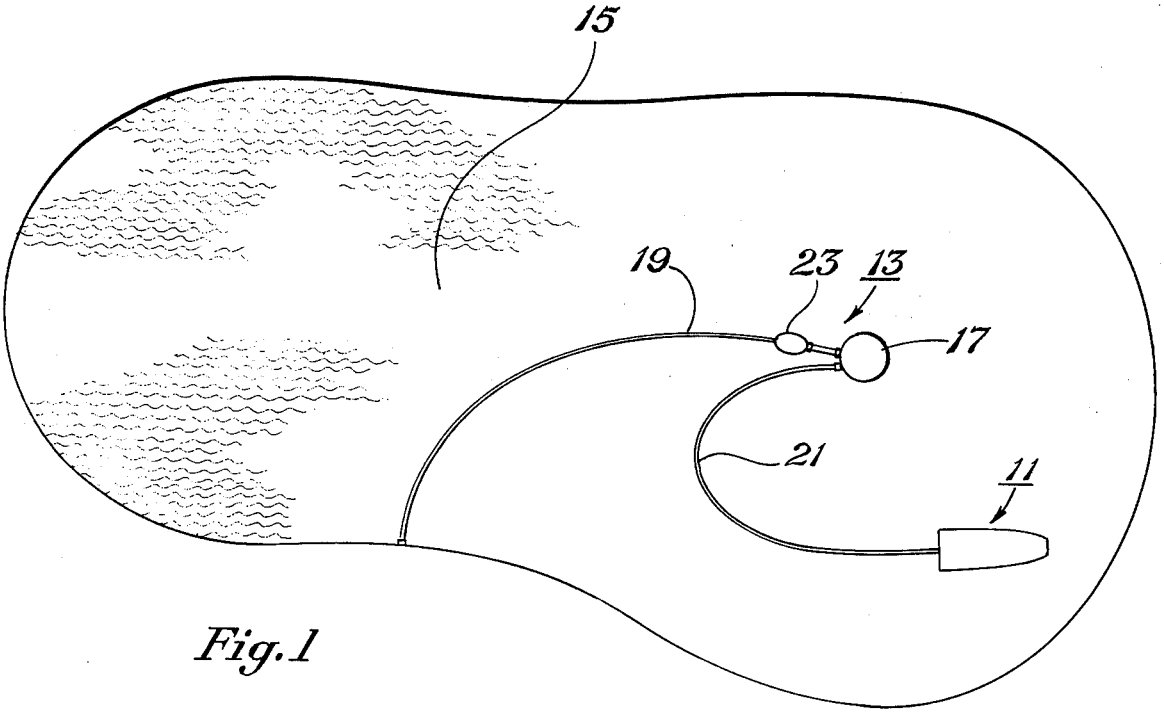
FIG. 1 is a top plan view of the leaf cleaning device in accordance with this invention attached to an automatic pool cleaner in a swimming pool.

FIG. 1 illustrates a leaf and debris collecting device 11 connected to an automatic pool cleaner 13 and a swimming pool 15. The automatic pool cleaner 13 is comprised of a floating body 17 connected to a high pressure inlet hose 19 and having a high pressure outlet hose 21. The floating body 17 is buoyed by an adjacent float 23. As shown in FIG. 4, a reaction wheel 25 is empowered by the high pressure water to propel the floating body 17 around the pool, normally in cooperation with a jet (not shown). The high pressure water is normally supplied by the swimming pool circulation pump. With a non-rectangular pool, as shown in FIG. 1, the floating body 17 will generally propel itself around the sides of the pool, depending upon the length of inlet hose 19. Various designs of automatic swimming pool cleaners of this type are known in the art.

One or more high pressure outlet hoses 21 are attached to the floating body 17. These outlet hoses are flexible and have a nozzle 27, FIG. 4, that is weighted to keep the nozzle adjacent the bottom of the pool. Plastic bumpers 29 prevent wear on the hose from the abrading action as the high pressure spray from the nozzle 27 dislodges sediment from the pool. The reaction of the spray causes the hose 21 to continuously reposition itself in a writhing and sinuous fashion. Normally a short hose will be used for the sides of the pool and a longer hose for the bottom.

Figure 2:
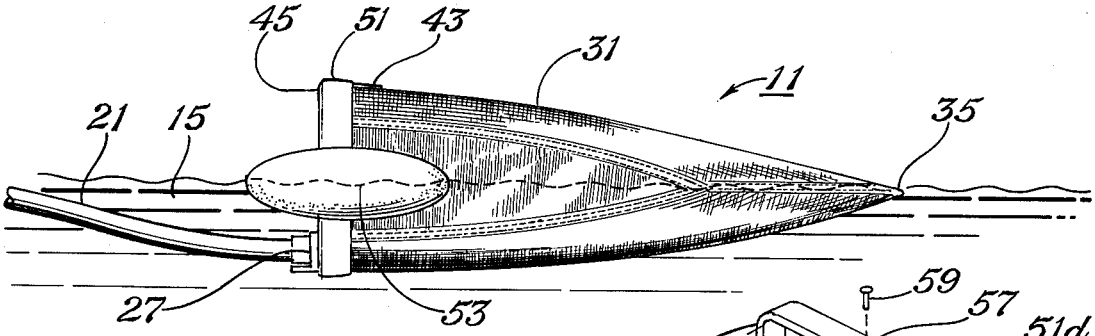
FIG. 2 is a side elevation view of the leaf collecting device in accordance with this invention, shown in a semi-submerged state.
Figure 3:
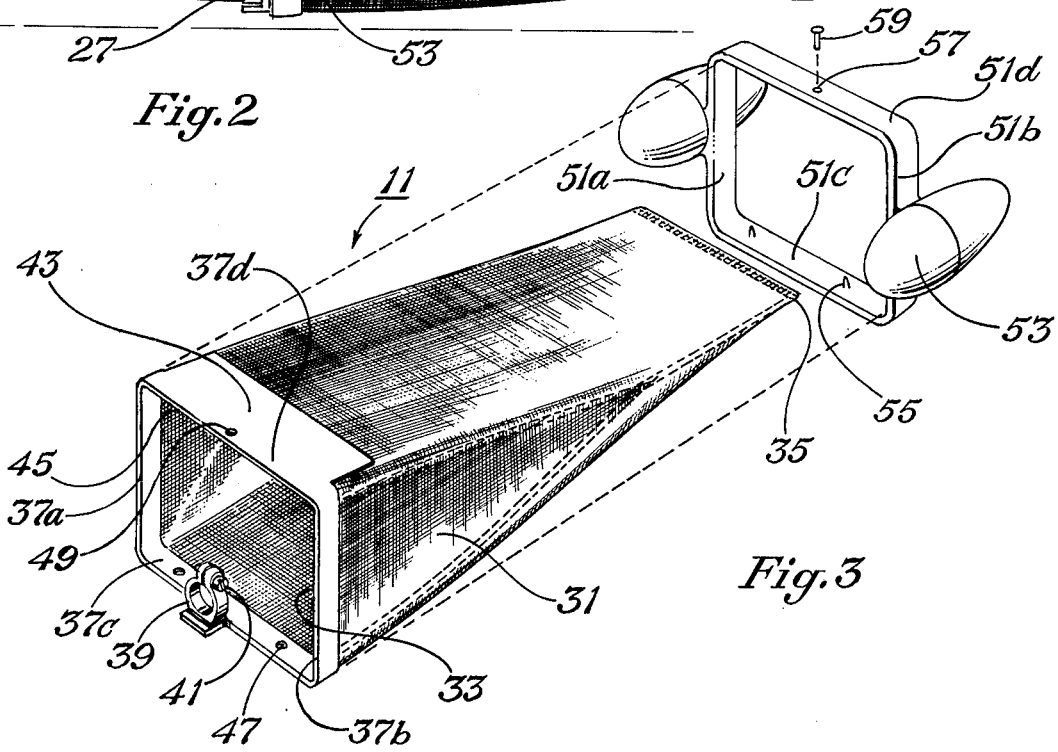
FIG. 3 is an exploded perspective view of the leaf collecting device shown in FIG. 2.

Referring to FIGS. 2 and 3, the leaf and debris collecting device 11 includes a reticulated bag 31. Bag 31 has an open mouth 33 and a closed end 35. The bag is generally wedge-shaped, and the closed end 35 is smaller in width than the mouth 33 in order to retain the leaves. The reticulated bag 31 is preferably of a woven flexible thermoplastic material, with the screen size sufficiently small to trap floating debris, yet large enough for water to freely pass through.

The mouth 33 of the bag is bonded to a semi-rigid rectangular hoop 37, that is preferably of plastic and has two sides **37*a* and 37*b*, a bottom 37*c* and a top 37*d*,** with reference to the bag orientation in FIGS. 2 and 3. The bottom 37*c* of the hoop has a connection means or clamp 39 for connecting the nozzle 27 to the reticulated bag 31. A screw 41 is provided to tighten the clamp against the nozzle. Connection means of various forms may be employed. The top 37*d* of hoop 37 has a flange 43 that projects inwardly generally along the longitudinal axis of the bag. Flange 43 projects inwardly 1 to 2 inches, and its outer edge 45 defines a straight line that is substantially perpendicular to the longitudinal axis of the reticulated bag 31. The edge 45 also is substantially perpendicular to sides 37*a* and 37*b*. Flange 43 serves as scraper means for scraping the bottom of the pool as the bag is drawn along to prevent leaves and debris from escaping, as will be described later. Lower side 37*c* has a pair of apertures 47 adjacent the connection means 39, and the upper side 37*d* has a single aperture 49 in the center.

Flotation means or float collar 51 is adapted to be inserted over and releasably connected to hoop 37. Float collar 51 is of a plastic material, rectangular, and has two sides 51*a* and 51*b*, a bottom 51*c* and a top 51*d*, with reference to the bag orientation in FIGS. 2 and 3. A pair of floats 53 are attached to the sides 51*a* and 51*b*. A pair of pins 55 extend upwardly from the inner side of bottom 51*c* for reception within apertures 47. An aperture 57 is provided on the top 51*d* for alignment with aperture 49. A pin 59 may be inserted to retain the float collar 51 to the bag 31. Numerous other means to releasably fasten the float collar to the bag may be employed. Floats 53 are positioned midway along the sides 51*a* and 51*b* so as to buoy the bag in a semi-submerged state, as shown in FIG. 2.

In operation, for cleaning surface leaves, the nozzle 27 of the high pressure outlet hose 21 is connected to the hoop 37. Float collar 51 is drawn over the hoop and fastened in place. High pressure outlet hose 21 is connected to the outlet discharge of the floating body 17. High pressure line 19 is connected to the floating body and high pressure water supplied. Floating body 17 should be in a mode of operation whereby it will continually move forward so as to prevent any loss of leaves from the bag 31 by reversing. As the floating body 17 moves, it drags the hose 21 and bag 31 along behind it. Leaves in the path of the open mouth 33 will enter the bag and be forced against the rear by the high pressure stream. The bag will generally follow the same path around the sides of the pool, where the majority of the leaves are normally found because of the circulation system of the pool. An entire cycle of the average home pool takes less than 5 minutes, consequently the leaf collector will collect many of the fallen leaves before they become water-logged and sink to the bottom. The pool cleaner may be left in continuous operation to patrol the pool while the pool is not in use.

FIG. 4 discloses the operation of the pool cleaner for cleaning leaves from the bottom 61 of the pool. For this operation, it may be necessary to use a longer hose than what is required for surface skimming. The hose should be long enough to reach the bottom with a portion of it trailing along the bottom surface. For this operation, the float collar 51 is removed from the hoop 37.

The operator plays out the hose 21 allowing the bag 31 to invert as it sinks, with flange 43 being on the bottom and connection means 39 on the top. Once the bag reaches the bottom, the weight of the average pool cleaning hose will tip the bag upwardly as shown in FIG. 4. Hose 21 should bend somewhat adjacent the nozzle, and the bottom 37*c* and connections means 39 also bend with respect to the longitudinal axis of the bag. The resultant spray is directed out toward the inward part of flange 43, and the longitudinal axis of the bag is approximately vertical. The nozzle 27 is on the forward side with respect to the flow of spray and flange 43 on the rearward side. The outer edge 45 of flange 43 is in direct contact with the pool bottom surface 61, being forced against it by the weight of the hose. As the high pressure water is supplied, floating body 17 pulls the hose along behind it with the flange scraping the bottom 61. Any leaves in the path will be drawn upward by the spray of the nozzle and retained within the bag. Flange 43 prevents leaves which have adhered to the bottom from escaping. After the bag is full or the operation is finished, the bag is drawn up and cleaned of leaves.

Although in the preferred embodiment, the bag is in a substantially vertical position while on the bottom, lesser angles are also satisfactory so long as the mouth is facing generally towards the pool bottom and flange 43 is in contact with the bottom. Moreover it is not necessary that the connection means 39 and bottom of the hoop be flexible; other connections means that are pivotal may also be employed. Also even if drawn along the bottom in a horizontal position with flange 43 on the upper side, the bag would capture a certain amount of leaves. It has been found however that due to the scraping action of the flange 43, better performance is achieved when used vertically as shown in FIG. 4.

FIG. 5 shows an alternate embodiment for hoop 37. Adjacent the outer edge 45 of flange 43 a pair of elongated members 63 are disposed laterally and slightly towards the opposite side. When the bag is in the vertical position on bottom the elongated members tend to direct the leaves inward, creating a wider path for the bag 31.

It is accordingly seen that an invention having significant improvements has been provided. An improved device for cleaning leaves and debris from swimming pools is provided that will work both for floating leaves and water-logged leaves found on the bottom of the pool. Manual operation is not necessary since the device is operable with commercially available automatic pool cleaners. The automatic pool cleaner drags the leaf collector about the surface of the pool or on the bottom of the pool, collecting leaves, without the need for one to be attendance.

The foregoing disclosure and the showings made in the drawings are merely illustrative of the principles of this invention and are not to be interpreted in a limiting sense.

I claim:

1. A method of cleaning leaves and debris from the bottom of a swimming pool, comprising the steps of:

connecting the mouth of a reticulated bag to the nozzle of an outlet hose of a swimming pool cleaner of the type that has a floating body, an inlet hose connected to a high pressure water supply, a flexible outlet hose for discharging high pressure spray for cleaning, and means for the body to self-propel itself about the swimming pool; the nozzle being oriented so as to direct water spray generally into the bag;

lowering the bag to the swimming pool bottom with the bag oriented so that the hose nozzle is on the upper portion of the mouth;

releasing the hose so that its weight causes the closed end of the bag to tip upwardly, with the mouth facing generally towards the swimming pool bottom and the nozzle on the forward portion of the mouth with respect to the spray, the rearward portion of the mouth being in contact with the swimming pool bottom; and providing water pressure to the swimming pool cleaner so that it will drag the hose and bag about the pool, the rearward edge of the mouth preventing leaves and debris from escaping.

2. A system for cleaning leaves and debris from swimming pools comprising:

an automatic swimming pool cleaner having a floating body and means, supplied by water pressure, for self-propelling itself about the swimming pool;

a flexible inlet hose connected to a high pressure water supply and to the floating body for supplying water;

a flexible outlet hose connected to the floating body and having a nozzle for discharging high pressure spray;

a reticulated bag connected to the nozzle of the outlet hose for being drawn about the swimming pool by the automatic swimming pool cleaner; the bag having an open mouth and a closed opposite end;

connection means for connecting the nozzle of the outlet hose to the mouth, the nozzle pointing towards the closed end of the bag for directing leaves and debris into the bag; and flotation means, attached to the mouth of the bag, for allowing the bag to float semi-submerged, with a portion of the bag being above the surface for receiving floating leaves and debris directed into the bag by the spray from the outlet hose.

3. The system according to claim 2 wherein the mouth is rectangular and the flotation means comprises a pair of floats, one on each side of the mouth.

4. In combination with an automatic swimming pool cleaner of the type having a floating body, an inlet hose connected to a high pressure water supply, a flexible outlet hose with a nozzle for discharging high pressure spray for cleaning, and means for the body to self-propel itself about the swimming pool, a leaf and debris collecting device comprising:

a reticulated bag connected to the nozzle of the outlet hose for being drawn about the swimming pool by the floating body; the bag having an open mouth and a closed opposite end;

connection means for connecting the nozzle of the outlet hose to the mouth so as to direct the high pressure spray towards the closed end of the bag to direct leaves and debris into the bag;

flotation means, connected to the bag, for allowing the bag to float semi-submerged, with a portion of the bag being above the surface for receiving floating leaves and debris directed into the bag by the spray from the outlet hose; the flotation means being detachable so that the bag may be drawn about the bottom of the swimming pool for collecting submerged leaves and debris; and scraper means, on the mouth, for scraping against the swimming pool bottom to prevent leaves and debris from escaping as the automatic swimming pool cleaner drags the bag along the swimming pool bottom.

5. The leaf and debris collecting device according to claim 4 wherein the flotation means comprises a collar fastened releasably around the mouth; and a pair of floats, one on each side of the collar.

6. The leaf and debris collecting device according to claim 4 wherein the scraper means comprises a flange having an outer edge that defines a straight line substantially perpendicular to the longitudinal axis of the bag.

7. The leaf and debris collecting device according to claim 6 wherein an elongated member is disposed laterally from each side of the flange for guiding leaves and debris into the mouth.

8. The leaf and debris collecting device according to claim 4 wherein the mouth comprises a rectangular hoop.

9. The leaf and debris collecting device according to claim 8 wherein the connection means is pivotal with respect to the longitudinal axis of the bag so that the bag may tip upwardly with the nozzle on the forward side with respect to the flow of the spray when on the bottom of the swimming pool.

10. For use with an automatic swimming pool cleaner of the type having a floating body, an inlet hose connected to a high pressure water supply, a flexible outlet hose with a nozzle for discharging high pressure spray for cleaning, and means for the body to self-propel itself about the swimming pool, a leaf and debris collecting device comprising:

a reticulated bag connected to the nozzle of the outlet hose for being drawn about the swimming pool by the floating body; the bag having an open mouth defined by a rectangular hoop and a closed opposite end;

connection means for connecting the nozzle of the outlet hose to one side of the hoop pointed generally towards the closed end for directing leaves and debris into the bag, the connection means allowing the nozzle to pivot with respect to the longitudinal axis of the bag; the opposite side of the hoop from the connection means having an outer edge that defines a straight line substantially perpendicular to the longitudinal axis of the bag; and a float collar, having floats attached and received over the hoop, for buoying the bag in a semi-submerged state; the float collar being detachable so that the nozzle and bag may be drawn about the bottom of the swimming pool for collecting submerged leaves and debris;

the outlet hose being of sufficient weight to be able to tip the closed end of the bag upwardly for cleaning the swimming pool bottom; the bag being oriented on bottom with the hoop facing generally towards the bottom of the swimming pool; the outer edge of the opposite side dragging against the swimming pool bottom as the automatic swimming pool cleaner drags the bag.

* * * * *